United States Patent [19]

Oda et al.

[11] 4,272,342

[45] Jun. 9, 1981

[54] ELECTROLYTIC GRAINING METHOD

[75] Inventors: Kazutaka Oda; Hisao Ohba, both of Shizuoka, Japan

[73] Assignee: Fuji Photo Film Co., Ltd., Minami-ashigara, Japan

[21] Appl. No.: 178,065

[22] Filed: Aug. 14, 1980

[30] Foreign Application Priority Data

Aug. 15, 1979 [JP] Japan ..... 54/103904

[51] Int. Cl.[3] ..... C25F 3/04

[52] U.S. Cl. ..... 204/129.4; 204/129.43; 204/129.75

[58] Field of Search ..... 204/129.4, 129.43, 129.75

[56] References Cited

U.S. PATENT DOCUMENTS 3,935,080 1/1976 Gumbinner ..... 204/129.75

4,087,341 5/1978 Takahashi ..... 204/129.75

*Primary Examiner*—T. M. Tufariello

*Attorney, Agent, or Firm*—Sughrue, Rothwell, Mion, Zinn and Macpeak

[57] ABSTRACT

A method for electrolytically graining the surface of an aluminum plate which comprises passing an alternating current through the aluminum plate in an acidic electrolyte so that $$Q_1 > Q_2 < Q_3$$

wherein $Q_1$, $Q_2$ and $Q_3$ represent the quantities of electricity per unit area of application, respectively, during the first $\frac{1}{3}$ period, the intermediate $\frac{1}{3}$ period and the final $\frac{1}{3}$ period of the total electrolytic graining time.

16 Claims, 1 Drawing Figure

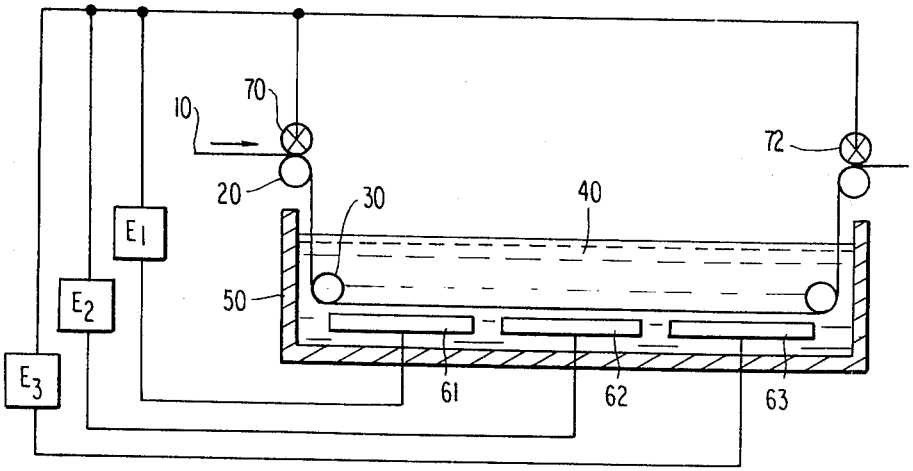
10
70
72
20
30
40
50
E1
E2
E3
61
62
63

ELECTROLYTIC GRAINING METHOD

BACKGROUND OF THE INVENTION

1. Field of the Invention

This invention relates to a method of electrolytically graining an aluminum plate, and more particularly to an electrolytic graining method which comprises passing an alternating current through an aluminum plate in an acidic electrolyte.

2. Description of the Prior Art

Aluminum plates have hitherto been used as supports for lithographic printing plates, and the surface thereof is usually grained for the purpose of increasing the adhesion force between the surface and a light-sensitive layer provided thereon, and improving the property of retaining a fountain solution which is applied at the time of printing.

With respect to such graining methods, mechanical graining methods, e.g., a ball graining method and a brush graining method, have long been known. Recently, however, attention has increasingly been paid to an electrolytic graining method, which is a method comprising electrolytically etching a surface of an aluminum plate by passing an alternating current through the aluminum plate in an acidic electrolyte, such as hydrochloric acid, nitric acid or the like.

This electrolytic graining method enables attainment of an aluminum plate having a uniformly grained surface which has a greater graininess than those obtained by conventional mechanical graining methods. Such a grained surface, however, can be obtained only under particular conditions: that is, although grained products having uniform performance can be obtained by controlling various conditions, including the composition of an electrolyte, the temperature, the electrolytic conditions, etc., it is required to control the electrolytic conditions precisely within a narrow range. It is, therefore, very difficult to effect an electrolytic graining method while controlling the electrolytic conditions within such a narrow range.

Furthermore, the graining of aluminum plates by the electrolytic graining method consumes a large quantity of electricity. Recently, therefore, the ratio of electricity costs to the overall production costs of printing plates has been increasing, which is undesirable from an economic viewpoint.

SUMMARY OF THE INVENTION

An object of this invention is to provide a method of electrolytically graining the surface of an aluminum plate which enables the attainment of a uniformly grained surface.

Another object of this invention is to provide an effective method of electrolytically graining the surface of an aluminum plate which consumes a reduced quantity of electricity.

A further object of this invention is to provide a method for electrolytically graining the surface of an aluminum plate which is suitable for obtaining a support for a lithographic printing plate.

This invention, therefore, provides a method of electrolytically graining the surface of an aluminum plate which comprises passing an alternating current through the aluminum plate in an acidic electrolyte solution so that $$Q_1 > Q_2 < Q_3$$

wherein $Q_1$, $Q_2$ and $Q_3$ represent the quantities of electricity per unit area of application, respectively, during the first $\frac{1}{3}$ period, the intermediate $\frac{1}{3}$ period, and the final $\frac{1}{3}$ period, of the total electrolytic graining time.

Unexpectedly, it has now been found that such relation between the electrolytic graining time and the quantity of electricity exerts great influences on the quantity of electricity required for graining the surface of the aluminum plate and on the uniformity in the graininess of the surface.

BRIEF DESCRIPTION OF THE DRAWING

The FIGURE is an illustrative sectional view of a processing apparatus in which electrolytic graining according to the invention can be carried out.

DETAILED DESCRIPTION OF THE INVENTION

The term "an aluminum plate" as used in this invention includes a pure aluminum plate and an aluminum alloy plate. Various aluminum alloys can be used, including those alloys of aluminum and metals such as silicon, copper, manganese, magnesium, chromium, zinc, lead, bismuch, and nickel.

Prior to the electrolytic graining of the aluminum plate, if necessary, a process to remove a rolling oil or grease on the surface of the aluminum plate, and/or a process to expose a clean aluminum surface can be applied. In the former process, the surface of the aluminum plate is washed with a solvent such as trichloroethylene, a surface active agent or the like. For the latter process, there is widely used a method wherein the surface of the aluminum plate is etched using an alkali etching agent, e.g., sodium hydroxide, potassium hydroxide, etc.

The chemical etching in an aqueous solution of a base generally produces smuts on the surface of the aluminum plate. In this case, it is preferred to apply a so-called desmutting treatment, viz., to treat the plate with phosphoric acid, nitric acid, chromic acid or a mixed acid comprising two or more thereof.

In accordance with the method of this invention, an alternating current is passed through the aluminum plate in the acidic electrolyte so that $$Q_1 > Q_2 < Q_3 \qquad \text{(I)}$$

wherein $Q_1$, $Q_2$, $Q_3$ represent the quantities of electricity per unit area of application, respectively, during the first $\frac{1}{3}$ period, the intermediate $\frac{1}{3}$ period, and the final $\frac{1}{3}$ period of the total electrolytic graining time, to thereby electrolytically grain the surface of the aluminum plate.

The electrolytic graining of the aluminum plate under conditions as described above produces a grained surface wherein fine irregularities are uniformly formed and, furthermore, it enables a reduction in the total quantity of electricity (i.e., $Q_0 = Q_1 + Q_2 + Q_3$) required for obtaining the desired grained surface, leading to a reduction in the consumed electric power.

If any of the cases wherein $Q_1 < Q_2 \leqq Q_3$, $Q_1 < Q_2 > Q_3$, or $Q_1 = Q_2 = Q_3$, it is found that the quantity of electricity $Q_0$ required to achieve the desired surface graining increases. Furthermore, in the case of $Q_1 > Q_2 \geqq Q_3$, fine irregularities are not uniformly formed, and a grained surface is obtained wherein greater pits than other ones are scattered in uniform fine pitting. Therefore, the electrolytic graining of the aluminum plate under conditions so as to meet the requirements of equation (I) is very important for effectively obtaining a uniformly grained surface.

In a particularly preferred embodiment of this invention, the electrolytic graining of the aluminum plate is carried out so that $$Q_1 > Q_3 > Q_2 \quad \text{(II)}$$

wherein $Q_1$, $Q_2$, and $Q_3$ are the same quantities as defined in equation (I).

In equation (I), the ratios of $Q_1/Q_2$ and $Q_3/Q_2$ are preferably each from about 1.05/1 to 2.0/1. In the equation (II), the ratios of $Q_1/Q_2$ and $Q_3/Q_2$ are, respectively, preferably from about 1.05/1 to 1.7/1 and from about 1.05/1 to 1.7/1, and more preferably from 1.2/1 to 1.5/1 and from 1.1/1 to 1.4/1.

As the acidic electrolyte used in the electrolytic graining method of this invention, hitherto known acidic electrolytes can be used; particularly, an aqueous solution containing halogen ions or nitric acid ions which is capable of corroding aluminum can be used. The particularly preferred electrolytes are an aqueous solution of hydrochloric acid, nitric acid, or a mixture thereof, and the concentration of electrolyte is appropriately selected from the range of from about 0.5% to 5% by weight, based on the weight of the solution.

To this electrolytic solution can further be added a corrosion inhibitor (also referred to as a "stabilizer"). For example, in the case of a hydrochloric acid electrolytic bath, chlorides such as ammonium chloride, zinc chloride, sodium chloride, aluminum chloride, etc., monoamines such as trimethylamine, triethylamine, dimethylamine, diethylamine, methylamine, ethylamine, carbamic acid, triethanolamine, diethanolamine, monoethanolamine, etc., diamines such as ethylenediamine, hexamethylenediamine, etc., aldehydes such as formaldehyde, acetaldehyde, n-hexylaldehyde, etc., acids such as phosphoric acid, chromic acid, nitric acid, etc., or the like, can be added. In the case of a nitric acid electrolytic bath, nitrates such as zinc nitrate, ammonium nitrate, sodium nitrate, etc., the monoamines, diamines and aldehydes as described above, acids such as phosphoric acid, chromic acid, sulfosalicylic acid, etc., or the like can be added.

The amount of the corrosion inhibitor added to the electrolyte solution is preferably selected from the range of from about 0.05% to 3% by weight, based on the weight of the solution.

The alternating current as used in the electrolytic graining method of this invention can be represented by a wave form obtained by alternately changing the polarity, and it includes alternating currents in a rectangular wave form, a trapezoidal wave form, etc., as well as a sinusoidal single phase alternating current and a sinusoidal three phase alternating current.

In a preferred embodiment of this invention, the alternating current is passed through the aluminum plate in the acidic electrolyte so that $Q_a$, the quantity of electricity at the time when the plate is the anode, is greater than $Q_c$, the quantity of electricity at the time when the plate is the cathode. More preferably, the ratio of $Q_c/Q_a$ is preferably from 0.3/1 to 0.8/1. In such a case, as described in U.S. Pat. No. 4,087,341, it is preferred to pass an alternating current through the aluminum plate at such a voltage that the voltage at the time when the plate is the anode is greater than that at the time when the plate is the cathode, so that the quantity of electricity passing at the time when the plate is the anode will be greater than that at the time when the plate is the cathode.

The voltage applied to the aluminum plate is preferably from about 1 volt to 50 volts, and more preferably from 2 volts to 30 volts; the current density is preferably from about 10 amperes/dm$^2$ to 100 amperes/dm$^2$, and more preferably from 10 amperes/dm$^2$ to 80 amperes/dm$^2$; and the quantity of electricity passed is preferably from about 100 coulombs/dm$^2$ to 30,000 coulombs/dm$^2$, and more preferably from 100 coulombs/dm$^2$ to 18,000 coulombs/dm$^2$. The temperature of the electrolytic solution is preferably from about 10° C. to 45° C., and more preferably from 15° C. to 45° C. These ranges are practically useful, but the present invention is not limited thereto.

The electrolytic graining method of this invention is particularly advantageous in the continuous processing of an aluminum web.

The FIGURE of the drawing is a schematic cross-sectional view of an electrolytic graining apparatus which can be used in the practice of this invention, in which an aluminum web 10 is fed into an electrolytic bath 50 filled with an acidic electrolyte 40 in the direction of an arrow by rolls 20 and 30. In the electrolytic bath 50 carbon electrodes 61, 62 and 63 are provided, in such a manner that they face the aluminum web 10. The aluminum web 10 is connected through current-feeding rolls 70 and 72 to one pole of each of electric sources $E_1$, $E_2$ and $E_3$. Electrodes 61, 62 and 63 are connected to the other poles of electric sources $E_1$, $E_2$ and $E_3$, respectively. An alternating current is passed between the aluminum web 10 and the electrodes 61, 62 and 63 to electrolytically grain the surface of the aluminum web 10. At this time, the voltages $E_1$, $E_2$ and $E_3$ applied between the aluminum web 10 and the electrodes 61, 62 and 63 are controlled so as to meet the requirements indicated by the above equation (I), and preferably also equation (II).

Alternatively, the requirements indicated by equation (I) can be met by controlling the distance between the aluminum web 10 and each of the electrodes 61, 62 and 63.

Since it presents no technical problem for one skilled in the art to control the conditions so as to meet the requirements of equation (I) or (II), the foregoing explanation is considered sufficient.

While the thus-processed aluminum plate has excellent capabilities as a support for use in a lithographic printing plate, it may further be subjected to such treatments as an anodic oxidation treatment and a chemical treatment, if desired.

The anodic oxidation treatment may be applied immediately after the water-washing of the aluminum plate as treated above. However, since smuts are typically formed on the electrolytically grained surface of the aluminum plate, it is preferred to first apply a desmutting treatment to remove these smuts. Such a desmutting treatment is carried out by bringing the surface of the aluminum plate in contact with an aqueous solution of an acid or base by, for example, a dipping method. As such an acid, phosphoric acid, sulfuric acid, chromic acid or the like can be used, and as a base, there can be used those which are used in the chemical etching as described hereinbefore.

Particularly preferred among desmutting treatments are a method as described in Japanese patent application (OPI) No. 12739/78 (the term "OPI" as used herein refers to a "published unexamined Japanese patent application") wherein the surface of the aluminum plate is brought in contact with from 15 to 65% by weight sulfuric acid at a temperature of from 50° C. to 90° C. and an alkali etching method as described in Japanese Patent Publication No. 28123/73.

The anodic oxidation treatment can be carried out by a method as conventionally used in this art. In more detail, by passing a direct or alternating current through aluminum in an aqueous or nonaqueous solution of sulfuric acid, phosphoric acid, chromic acid, oxalic acid, sulfamic acid, benzenesulfonic acid or the like or a mixture comprising two or more thereof, an anodic oxidized coating can be formed on the surface of the aluminum plate.

While the conditions under which the anodic oxidation is carried out vary depending upon the electrolyte used and they cannot be stated categorically, it is generally suitable that the concentration of the electrolyte is from 1% by weight to 80% by weight, the liquid temperature is from 5° C. to 70° C., the current density is from 0.5 amperes/dm$^2$ to 60 amperes/dm$^2$, the voltage is from 1 V to 100 V, and the electrolytic time is from 30 seconds to 50 minutes.

Preferred anodic oxidation methods include the method as described in British Pat. No. 1,412,768, wherein the anodic oxidation is carried out in sulfuric acid at a high current density, and the method as described in U.S. Pat. No. 3,511,661, wherein the anodic oxidation is carried out in an electrolytic bath of phosphoric acid.

The thus-anodized oxidized aluminum plate can be further treated by dipping in an aqueous solution of alkali metal silicate, e.g., sodium silicate, as described in U.S. Pat. Nos. 2,714,066 and 3,181,461, and it can be provided with an undercoating layer of a hydrophilic cellulose (e.g., carboxymethyl cellulose) containing a water-soluble metal salt (e.g., zinc acetate) as described in U.S. Pat. No. 3,860,426, to form a lithographic support.

On the thus-obtained support for use in the lithographic printing plate a light-sensitive layer can be provided which has hitherto been known as a light-sensitive layer of a PS plate (abbreviation of Pre-Sensitized Plate) to obtain a light-sensitive lithographic printing plate from which a lithographic printing plate having excellent capabilities can be obtained.

As a composition for the above light-sensitive layer, any composition can be employed which changes its solubility and swelling properties in a developer before and after light-exposure. Representative examples of such compositions are well known in the art and are described in detail in published British patent application No. 2030309A.

The thus-obtained light-sensitive lithographic printing plate is imagewise exposed with a mercury lamp, a metal halide lamp or the like as a light source and processed with a suitable developer to obtain a lithographic printing plate.

The following examples, comparative examples and reference example are given to illustrate this invention in greater detail. All percents (%) are by weight unless otherwise indicated.

EXAMPLE 1

A 300 mm wide, 0.24 mm thick aluminum web (purity: 99.5% or more) was continuously processed as follows:

The aluminum web was degreased by dipping it in a 10% aqueous solution of sodium hydroxide at 50° C. for 60 seconds and washed with flowing water and, thereafter, it was desmutted with 20% nitric acid and washed with water.

The aluminum web prepared from a thus-treated web was electrolyzed in an electrolyte of an aqueous solution of nitric acid having a concentration of 7 g/l by use of an electric source as described in U.S. Pat. No. 4,087,341, i.e., a rectangular wave form alternating current voltage of a frequency of 60 Hz, a voltage when the plate is the anode of 14 V, and a voltage when the plate is the cathode of 9 V, so that the ratio ($Q_c/Q_a$) of the quantity of electricity when the plate is the cathode ($Q_c$) to the quantity of electricity when the plate is the anode ($Q_a$) be 0.7. The aluminum web was moved in the electrolyte as illustrated in the drawing so that it was dipped therein for 80 seconds, and during this period the aluminum web travelled a distance of 2.1 m.

The quantities of electricity: $Q_1$, $Q_2$, and $Q_3$ applied in the first 0.7 m zone, the second 0.7 m zone and the third 0.7 m zone, respectively, (corresponding to the first $\frac{1}{3}$ period, the intermediate $\frac{1}{3}$ period and the final $\frac{1}{3}$ period) were controlled to 40,000 coulombs/min, 28,000 coulombs/min and 32,000 coulombs/min, respectively, with the total quantity of electricity being 100,000 coulombs/min.

The electrolytically grained aluminum web had a surface with a surface roughness (Ra) of 0.70 and uniform pits were formed over the whole surface of the aluminum web.

COMPARATIVE EXAMPLE 1

In the same manner as in Example 1 except that $Q_1$=50,000 coulombs/min, $Q_2$=30,000 coulombs/min and $Q_3$=20,000 coulombs/min, the same aluminum web as used in Example 1 was processed.

The bits formed on the surface of the aluminum web was not uniform, and large pits were partly produced therein. The surface roughness (Ra) of the grained surface was 1.0$\mu$.

COMPARATIVE EXAMPLE 2

In the same manner as in Example 1 except that $Q_1$=28,000 coulombs/min, $Q_2$=32,000 coulombs/min and $Q_3$=40,000 coulombs/min, the same aluminum web as used in Example 1 was processed.

Although uniform pits were formed on the surface of the aluminum web, the surface roughness (Ra) was only 0.5$\mu$. In order to increase Ra to 0.70$\mu$ or more, the electrolytic period had to be lengthened to 120 seconds or more.

EXAMPLES 2-4 AND COMPARATIVE EXAMPLES 3-4

In the same manner as in Example 1 except that $Q_1$, $Q_2$ and $Q_3$ were controlled as illustrated in Table 1 below, the same aluminum web as used in Example 1 was processed.

The uniformity of the grained surface and the surface roughness of each of the thus-processed aluminum webs are shown in the table.

TABLE 1

| | $Q_1$ Col/min | $Q_2$ Col/min | $Q_3$ Col/min | Uniformity | Ra |
|---|---|---|---|---|---|
| Example 2 | 38,000 | 28,000 | 34,000 | good | 0.68 |
| Example 3 | 42,000 | 25,000 | 33,000 | good | 0.72 |
| Example 4 | 43,000 | 26,000 | 31,000 | good | 0.74 |
| Comparative Example 3 | 45,000 | 30,000 | 25,000 | poor | 0.85 |
| Comparative Example 4 | 25,000 | 30,000 | 45,000 | poor | 0.52 |

REFERENCE EXAMPLE

The aluminum plate as obtained in Example 1 was washed with water, dipped in a 15% aqueous solution of sulfuric acid at 50° C. for 3 minutes to effect desmutting and then anodized in an aqueous solution of sulfuric acid having a concentration of 200 g $H_2SO_4$/l at a current density of 2 amperes/dm$^2$ to form an oxidized coating film of 3 g/m$^2$.

After water-washing and drying, the aluminum plate was coated with the following light-sensitive solution to obtain a dry weight of 2.5 g/m$^2$, whereby a light-sensitive printing plate was obtained.

| Composition of Light-Sensitive Solution | |
|---|---|
| Naphthoquinone-1,2-diazido(2)-5-sulfonic Acid Ester of Acetone-Pyrogallol Resin (synthesized by the method as disclosed in Example 1 of U.S. Pat. No. 3,635,709) | 5 g |
| PR-50530 (tert-butylphenol-formaldehyde resin, produced by Sumitomo Duretz Co., Ltd.) | 0.5 g |
| Hitanol #3110 (cresol-formaldehyde resin, produced by Hitachi Chemical Industries, Ltd.) | 5 g |
| Methyl Ethy Ketone | 50 g |
| Cyclohexanone | 40 g |

The thus-obtained light-sensitive lithographic printing plate was exposed through a transparent positive film in a vacuum printing frame to Fuji Film PS Light (Toshiba metal halide lamp MU 2000-2-OL with a light source of 3 kw, sold by Fuji Photo Film Co., Ltd.) placed at a distance of 1 m therefrom for 30 seconds. Thereafter, it was developed with a 5.26% aqueous solution of sodium silicate ($SiO_2/Na_2O=1.74$) (pH=12.7) and coated with a 14° Be aqueous solution of gum arabic.

The thus-obtained lithographic printing plate was then placed on a printing press and used in offset printing. The control of a fountain solution was facilitated, and the printing could be carried out with ease. Printed reproductions obtained were excellent in the reproduction of fine image areas. Furthermore, the press life was good, and 50,000 copies could be obtained without deterioration of the reproduction.

While the invention has been described in detail and with reference to specific embodiments thereof, it will be apparent to one skilled in the art that various changes and modifications can be made therein without departing from the spirit and scope thereof.

What is claimed is:

1. A method for electrolytically graining the surface of an aluminum plate comprising passing an alternating current through the aluminum plate in an acidic electrolyte solution, wherein the alternating current is passed so that $$Q_1>Q_2<Q_3 \quad (I)$$

wherein $Q_1$, $Q_2$ and $Q_3$ represent the quantities of electricity per unit area of application, respectively, during the first $\frac{1}{3}$ period, the intermediate $\frac{1}{3}$ period, and the final $\frac{1}{3}$ period, of the total electrolytic graining time.

2. A method for electrolytically graining the surface of an aluminum plate as in claim 1, wherein the alternating current is passed so that $$Q_1>Q_3>Q_2$$

wherein $Q_1$, $Q_2$, and $Q_3$ are the same quantities as defined in claim 1.

3. A method for electrolytically graining the surface of an aluminum plate as in claim 1, wherein the ratios of $Q_1/Q_2$ and $Q_3/Q_2$ are each from about 1.05/1 to 2.0/1.

4. A method for electrolytically graining the surface of an aluminum plate as in claim 2, wherein the ratios of $Q_1/Q_2$ and $Q_3/Q_2$ are from about 1.05/1 to 1.7/1, and from about 1.05/1 to 1.7/1, respectively.

5. A method for electrolytically graining the surface of an aluminum plate as in claim 2, wherein the ratios of $Q_1/Q_2$ and $Q_3/Q_2$ are from about 1.2/1 to 1.5/1, and from about 1.1/1 to 1.4/1, respectively.

6. A method for electrolytically graining the surface of an aluminum plate as in claim 1, 2, 3, 4, or 5, wherein the electrolyte solution is an aqueous solution of hydrochloric acid, nitric acid, or a mixture thereof, and the concentration of electrolyte is from about 0.5 to 5% by weight, based on the weight of the solution.

7. A method for electrolytically graining the surface of an aluminum plate as in claim 6, wherein the electrolytic solution contains a corrosion inhibitor in an amount from about 0.05% to 3% by weight, based on the weight of the solution.

8. A method for electrolytically graining the surface of an aluminum plate as in claim 1, 2, 3, 4, or 5, wherein the voltage is from about 1 volt to 50 volts.

9. A method for electrolytically graining the surface of an aluminum plate as in claim 8 wherein the voltage is from about 2 volts to 30 volts.

10. A method for electrolytically graining the surface of an aluminum plate as in claim 1, 2, 3, 4, or 5, wherein the current density is from about 10 amperes/dm$^2$ to 100 amperes/dm$^2$.

11. A method for electrolytically graining the surface of an aluminum plate as in claim 10, wherein the current density is from about 10 amperes/dm$^2$ to 80 amperes/dm$^2$.

12. A method for electrolytically graining the surface of an aluminum plate as in claim 1, 2, 3, 4, or 5, wherein the quantity of electricity passed is from about 100 coulombs/dm$^2$ to 30,000 coulombs/dm$^2$.

13. A method for electrolytically graining the surface of an alumium plate as in claim 12, wherein the quantity of electricity passed is from about 100 coulombs/dm$^2$ to 18,000 coulombs/dm$^2$.

14. A method for electrolytically graining the surface of an aluminum plate as in claim 1, 2, 3, 4, or 5, wherein the temperature of the electrolytic solution is from about 10° C. to 45° C.

15. A method for electrolytically graining the surface of an aluminum plate as in claim 14, wherein the temperature of the electrolytic solution is from about 15° C. to 45° C.

16. A method for electrolytically graining the surface of an aluminum plate as in claim 13, wherein said aluminum plate has been preliminarily subjected to mechanical graining and the quantity of electricity passed is from 200 coulombs/dm$^2$ to 4,000 coulombs/dm$^2$.

* * * * *